US009064610B2

(12) United States Patent
Lee et al.

(10) Patent No.: US 9,064,610 B2
(45) Date of Patent: Jun. 23, 2015

(54) BETAVOLTAIC BATTERY WITH DIAMOND MODERATOR AND RELATED SYSTEM AND METHOD

(75) Inventors: Chae Deok Lee, Acton, MA (US); Ralph Korenstein, Framingham, MA (US); Mary K. Herndon, Littleton, MA (US)

(73) Assignee: Raytheon Co., Waltham, MA (US)

( * ) Notice: Subject to any disclaimer, the term of this patent is extended or adjusted under 35 U.S.C. 154(b) by 507 days.

(21) Appl. No.: 13/440,597

(22) Filed: Apr. 5, 2012

(65) Prior Publication Data

US 2013/0264907 A1 Oct. 10, 2013

(51) Int. Cl.
*G21H 1/06* (2006.01)

(52) U.S. Cl.
CPC ..... *G21H 1/06* (2013.01)

(58) Field of Classification Search
USPC ..... 310/303; 136/202
See application file for complete search history.

(56) References Cited

U.S. PATENT DOCUMENTS 2,976,433 A * 3/1961 Rappaport et al. ..... 310/303
3,706,893 A * 12/1972 Olsen et al. ..... 310/303
4,275,405 A * 6/1981 Shannon ..... 257/252
4,571,447 A * 2/1986 Prins ..... 136/252
4,663,115 A * 5/1987 Russell ..... 376/320
5,440,187 A * 8/1995 Little et al. ..... 310/303
6,753,469 B1 * 6/2004 Kolawa et al. ..... 136/253
8,487,507 B1 * 7/2013 Cabauy et al. ..... 310/303
8,802,456 B2 * 8/2014 Spencer et al. ..... 438/19
8,866,152 B2 * 10/2014 Lal et al. ..... 257/77
8,866,245 B2 * 10/2014 Spencer et al. ..... 257/428
2009/0026879 A1 * 1/2009 Prelas ..... 310/303

* cited by examiner

*Primary Examiner* — Burton Mullins

(57) ABSTRACT

An apparatus includes a beta particle source configured to provide beta particles. The apparatus also includes a diamond moderator configured to convert at least some of the beta particles into lower-energy electrons. The apparatus further includes a PN junction configured to receive the electrons and to provide electrical power to a load. The diamond moderator is located between the beta particle source and the PN junction. The apparatus could also include an electron amplifier configured to bias the diamond moderator. For example, the electron amplifier could be configured to receive some of the beta particles and to generate additional electrons that bias the diamond moderator. Also, the diamond moderator can be configured to receive the beta particles having energies that are spread out over a wider range including higher energies, and the diamond moderator can be configured to provide the electrons concentrated in a narrower range at lower energies.

20 Claims, 2 Drawing Sheets

BETAVOLTAIC BATTERY WITH DIAMOND MODERATOR AND RELATED SYSTEM AND METHOD

TECHNICAL FIELD

This disclosure is directed in general to power supplies. More specifically, this disclosure is directed to a betavoltaic battery with a diamond moderator and related system and method.

BACKGROUND

Numerous types of electronic devices and systems use internal or external batteries to provide operating power to the devices and systems. In many cases, lengthening the operational lifespan of a battery is extremely helpful in prolonging the operation and reducing the maintenance of a device or system. Moreover, some applications require power supplies that provide power for extended periods of time, such as for more than ten years. Unfortunately, many standard types of batteries, such as lithium ion and nickel cadmium batteries, cannot provide the required operating power for this length of time. As such, other techniques are often needed to reduce the device or system's power consumption, such as by using synchronized sleep cycles combined with multiple waveforms for fast acquisition and high data rate transfers in wireless devices.

SUMMARY

This disclosure provides a betavoltaic battery with a diamond moderator and related system and method.

In a first embodiment, an apparatus includes a beta particle source configured to provide beta particles. The apparatus also includes a diamond moderator configured to convert at least some of the beta particles into lower-energy electrons. The apparatus further includes a PN junction configured to receive the electrons and to provide electrical power to a load. The diamond moderator is located between the beta particle source and the PN junction.

In a second embodiment, a system includes a load configured to receive electrical power and a betavoltaic battery. The betavoltaic battery includes a beta particle source configured to provide beta particles. The betavoltaic battery also includes a diamond moderator configured to convert at least some of the beta particles into lower-energy electrons. The betavoltaic battery further includes a PN junction configured to receive the electrons and to provide the electrical power to the load. The diamond moderator is located between the beta particle source and the PN junction.

In a third embodiment, a method includes generating beta particles using a beta particle source. The method also includes converting at least some of the beta particles into lower-energy electrons using a diamond moderator. The method further includes providing electrical power to a load based on the electrons using a PN junction. The diamond moderator is located between the beta particle source and the PN junction.

Other technical features may be readily apparent to one skilled in the art from the following figures, descriptions, and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Figure 1:
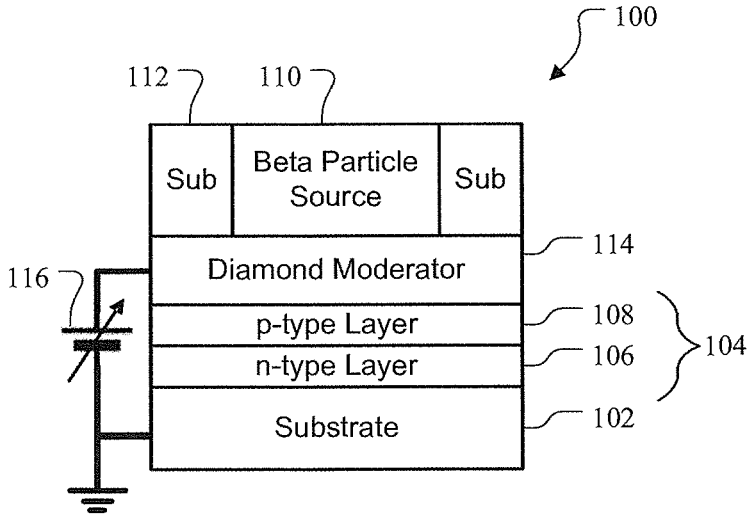
FIG. 1 illustrates an example betavoltaic battery with a diamond moderator in accordance with this disclosure.
Figure 2:
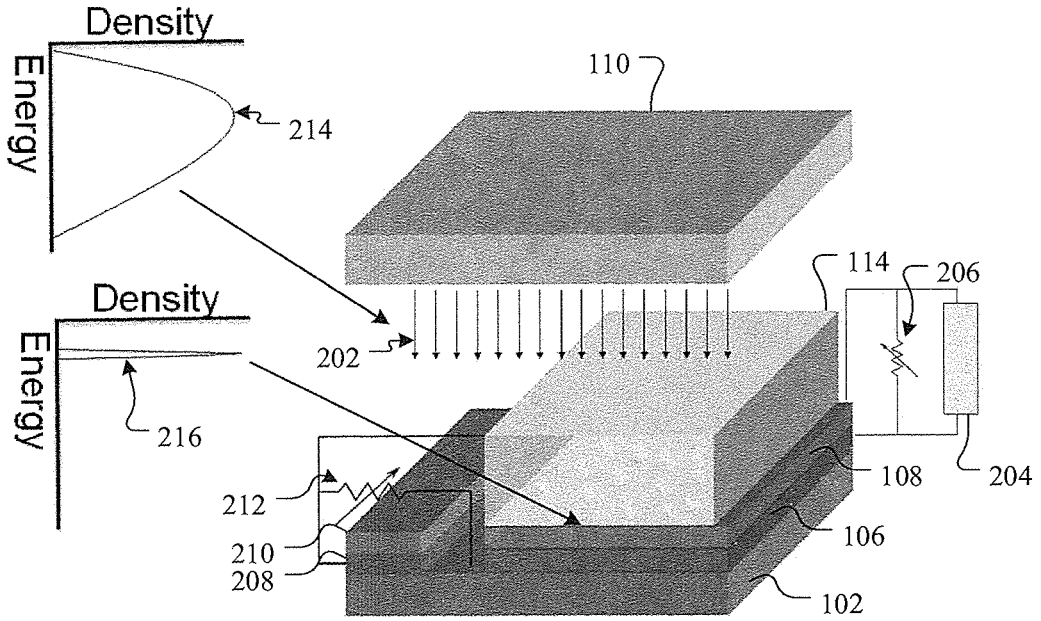
FIG. 2 illustrates additional details of an example betavoltaic battery with a diamond moderator in accordance with this disclosure.
Figure 3:
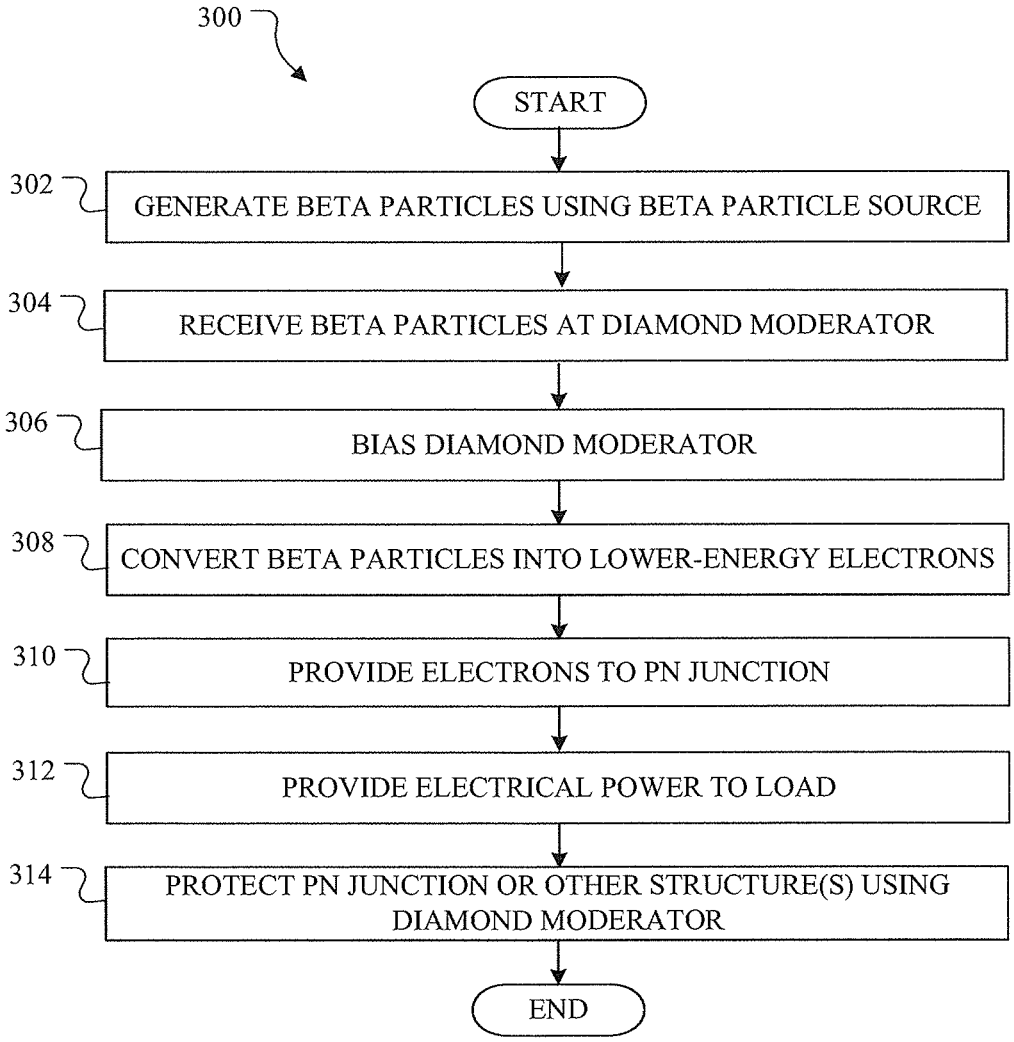
FIG. 3 illustrates an example method for generating power using a betavoltaic battery with a diamond moderator in accordance with this disclosure.

FIG. 1 through 3, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

FIG. 1 illustrates an example betavoltaic battery 100 with a diamond moderator in accordance with this disclosure. As shown in FIG. 1, the betavoltaic battery 100 includes a substrate 102. The substrate 102 represents any suitable structure that covers, supports, or carries other components of the betavoltaic battery 100. For example, the substrate 102 could represent a wafer or other substrate structure formed from silicon, gallium nitride, boron nitride, diamond, silicon carbide, or other material(s).

A PN junction 104 is located over the substrate 102. The PN junction 104 represents a structure formed using at least one p-type semiconductor material in contact with at least one n-type semiconductor material. In this example, the PN junction 104 includes an n-type layer 106 and a p-type layer 108. The n-type layer 106 can be formed from any suitable n-type material(s) and in any suitable manner. The p-type layer 108 can be formed from any suitable p-type material(s) and in any suitable manner. For example, the layers 106-108 could be formed by doping layers of silicon, silicon carbide, gallium nitride, boron nitride, or other material(s) with suitable p-type and n-type dopants.

A beta particle source 110 is located over the PN junction 104. The beta particle source 110 provides beta particles for generating power for external devices or systems. The beta particle source 110 includes any suitable material(s) that generate beta particles. The beta particle source 110 could, for example, include tritium, nickel, krypton, promethium, or strontium-yttrium isotopes. Note that any other suitable material(s) that generate beta particles could be used. Ideally, the beta particle source 110 has a suitable half-life to enable the battery 100 to be used to provide power during a desired length of time. In particular embodiments, the beta particle source 110 provides beta particles to generate a suitable amount of power for up to ten years or more.

The beta particle source 110 is embedded within a substrate 112. The substrate 112 represents any suitable layer in which at least one beta particle source is embedded or otherwise located. In particular embodiments, the substrate 112 represents a silicon substrate, and a backetch process can be used to etch a space for the beta particle source 110. The beta particle source 110 can then be placed or formed within the space in the substrate 112.

Ordinarily, higher-energy beta particles are useful for generating larger amounts of power, but degradation of other structures in a battery can occur due to radiation damage from the beta particles. For example, beta particles could damage the materials in the PN layer 104, which can significantly shorten the lifespan of the battery 100.

In accordance with this disclosure, a diamond moderator 114 is located between the beta particle source 110 and the PN junction 104. The diamond moderator 114 converts higher-energy beta particles into lower-energy electrons with high density. The diamond moderator 114 includes any suitable diamond material, such as a monocrystalline or polycrystalline structure or structures. Also, the diamond material may or may not be doped, such as with boron, nitrogen, phosphorous, or other dopant(s). Some forms of diamond material, such as hydrogenated diamond, have a unique negative electron affinity so that electrons come out of the diamond's surface easily. Also, the energy of outgoing electrons is much lower (such as about 3-15 eV) compared to the energy of beta particles (often in the keV to MeV range). The diamond moderator 114 is therefore a radiation-hard structure that can be used to convert higher-energy beta particles into lower-energy electrons while protecting the underlying structures from the beta particles. This allows the beta particles to be used for power generation more effectively.

Among other things, the diamond moderator 114 significantly reduces radiation damage to the PN junction 104 and other underlying structures caused by the beta particle source 110. This therefore allows the use of higher-energy beta particle sources, resulting in improved power outputs. As a particular example, a krypton beta particle source 110 can be used to provide high-energy beta particles, such as around 250 keV. Moreover, some part of the betavoltaic battery 100 (such as the PN junction 104) can be used to supply a voltage or electric field to an external load. By varying the load's resistance (such as with a variable resistor coupled in parallel with the load), the output power of the battery 100 can be regulated against the half-life of the beta particle source 110. In addition, the percentage of transmitted electrons can be controlled by adjusting the thickness of the diamond moderator 114.

In this example, the battery 100 can further include an electron amplifier 116. The electron amplifier 116 helps to bias the diamond moderator 114 so that electrons escape more easily from the diamond moderator 114 in response to the beta particles. The electron amplifier 116 includes any suitable structure for biasing a diamond moderator in a betavoltaic battery. For example, the electron amplifier 116 could include another PN junction that generates electrons for biasing the diamond moderator 114 in response to beta particles from the beta particle source 110.

In this way, a highly-compact battery 100 can be created. Also, the battery 100 can find use in a wide range of applications. For example, the betavoltaic battery 100 could find use in a number of low-power devices, such as anti-tamper devices and remote sensors (including explosive and chemical sensors). The device in which a betavoltaic battery 100 is used could also support various techniques to help reduce or minimize power consumption, such as by using synchronized sleep cycles combined with multiple waveforms for fast acquisition and high data rate transfers in a wireless device. In particular embodiments, a betavoltaic battery 100 could be used in a device that consumes about 20 nA or less of current while in sleep mode, and the battery 100 could provide adequate power for at least about 20 years of operation of the device. The betavoltaic battery 100 can therefore be useful in applications such as extremely low power (XLP) nano-Watt applications.

Although FIG. 1 illustrates one example of a betavoltaic battery 100 with a diamond moderator 114, various changes may be made to FIG. 1. For example, the size, shape, and dimensions of each component in FIG. 1 are for illustration only. Also, various components in FIG. 1 could be rearranged, such as when the n-type layer 106 is between the p-type layer 108 and the diamond moderator 114. In addition, various components could be omitted or further subdivided and additional components could be added according to particular needs. For instance, the electron amplifier 116 could be omitted.

FIG. 2 illustrates additional details of an example betavoltaic battery 100 with a diamond moderator 114 in accordance with this disclosure. As shown in FIG. 2, the betavoltaic battery 100 includes the beta source 110, which provides beta particles 202. The beta particles 202 impact the diamond moderator 114, and the diamond moderator 114 converts the higher-energy beta particles 202 into lower-energy electrons. The electrons are provided to the PN junction 104 formed by the layers 106-108, and the PN junction 104 provides a voltage or electrical current to an external load 204. The resistance of the load 204 can be controlled using a variable resistor 206 coupled in parallel with the load 204. As noted above, varying the resistance of the load 204 can help to regulate the output power of the battery 100 against the half-life of the beta particle source 110.

The load 204 includes any suitable structure that receives operating power from a betavoltaic battery. The load 204 could, for example, represent an anti-tamper device, a remote sensor, a miniature robot, or a device that operates by repeatedly entering and leaving a sleep state (which could include an anti-tamper device, a remote sensor, or other device). The resistor 206 includes any suitable resistive structure providing any suitable variable resistance. Note that if the resistance of the load 204 is known, a fixed resistor 206 could be used.

In this example, the electron amplifier 116 is implemented using a PN junction formed by an n-type region 208 and a p-type region 210. The n-type region 208 can be formed from any suitable n-type material(s) and in any suitable manner.

The p-type region 210 can be formed from any suitable p-type material(s) and in any suitable manner. For example, the regions 208-210 could be formed by doping regions of silicon carbide, gallium nitride, or diamond with suitable p-type and n-type dopants. In particular embodiments, the layers 106-108 can originally extend over the surface of the substrate 102, and an etch can be performed to separate the regions 208-210 from the remaining portions of the layers 106-108.

The n-type region 208 is coupled to the diamond moderator 114 and to a variable resistor 212, which is also coupled to the diamond moderator 114. The resistor 212 is coupled to the substrate 102 and the diamond moderator 114. The variable resistor 212 can be used to tune the overall resistance of the electron amplifier 116. The resistor 212 includes any suitable resistive structure providing any suitable variable resistance. Note that depending on the implementation, a fixed resistor 212 could be used.

FIG. 2 also illustrates the energy of the beta particles 202 entering the diamond moderator 114 (curve 214) and the energy of the electrons exiting the diamond moderator 114 (curve 216). As shown by the curve 214, the beta particles 202 have energies that are spread out over a wider range, with a larger number of beta particles 202 at higher energies. After the beta particles 202 have interacted with the diamond moderator 114, the electrons leave the diamond moderator 114 concentrated in a narrower range at lower energies as shown by the curve 216. In this way, the diamond moderator 114 can help to reduce or prevent damage caused to underlying components of the battery 100 by the beta particles 202.

Although FIG. 2 illustrates additional details of one example of a betavoltaic battery 100 with a diamond moderator 114, various changes may be made to FIG. 2. For example, the size, shape, and dimensions of each component in FIG. 2 are for illustration only. Also, various components in FIG. 2 could be rearranged, such as by reversing the n-type and p-type materials. Further, various components could be omitted or further subdivided and additional components could be added according to particular needs. For instance, the variable resistor 206 could be omitted if the resistance of the load 204 is suitable. In addition, the electron amplifier 116 could be implemented in any other suitable manner.

FIG. 3 illustrates an example method 300 for generating power using a betavoltaic battery with a diamond moderator in accordance with this disclosure. As shown in FIG. 3, beta particles are generated using a beta particle source at step 302. This could include, for example, generating the beta particles 202 using a tritium, nickel, krypton, promethium, strontium-yttrium, or other beta particle source 110.

Some of the beta particles are received at a diamond moderator at step 304. This could include, for example, receiving some of the beta particles at the upper surface of the diamond moderator 114. The diamond moderator is also biased at step 306. This could include, for example, using some of the beta particles to generate electrons for biasing the diamond moderator 114 using the electron amplifier 116.

The beta particles received by the diamond moderator are converted into lower-energy electrons at step 308. This could include, for example, the diamond moderator 114 providing electrons at the lower surface of the diamond moderator 114. The electrons are provided to a PN junction at step 310. This could include, for example, providing the electrons to the PN junction 104 under the diamond moderator 114. Electrical power is provided to a load at step 312. This could include, for example, the PN junction 104 providing a voltage or an electrical current to the load 204.

During these steps, the diamond moderator protects the PN junction or other underlying structure(s) of the betavoltaic battery at step 314. For example, the diamond moderator 114 can help to reduce or prevent beta particles 202 from striking the PN junction 104 or the substrate 102 under the diamond moderator 114. This can help to reduce damage to the betavoltaic battery 100 caused by the beta particles 202.

Although FIG. 3 illustrates one example of a method 300 for generating power using a betavoltaic battery with a diamond moderator, various changes may be made to FIG. 3. For example, while shown as a series of steps, various steps in FIG. 3 could overlap, occur in parallel, occur in a different order, or occur any number of times.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

a beta particle source configured to provide beta particles having energies that are spread out over a wider range including higher energies;

a diamond moderator configured to convert at least some of the beta particles into lower-energy electrons concentrated in a narrower range at lower energies; and a PN junction configured to receive the electrons and to provide electrical power to a load;

wherein the diamond moderator is located between the beta particle source and the PN junction.

2. The apparatus of claim 1, wherein:

the PN junction is located on a first substrate; and the beta particle source is located within a second substrate.

3. The apparatus of claim 1, wherein the diamond moderator comprises a diamond material and a dopant.

4. An apparatus comprising:

a beta particle source configured to provide beta particles;

a diamond moderator configured to convert at least some of the beta particles into lower-energy electrons;

a PN junction configured to receive the electrons and to provide electrical power to a load; and an electron amplifier configured to bias the diamond moderator;

wherein the diamond moderator is located between the beta particle source and the PN junction.

5. The apparatus of claim 4, wherein the electron amplifier is configured to receive some of the beta particles and to generate additional electrons that bias the diamond moderator.

6. The apparatus of claim 4, wherein the electron amplifier comprises a second PN junction and a resistor, the resistor coupled between a substrate and the diamond moderator, the resistor also coupled to one region of the PN junction.

7. The apparatus of claim 4, wherein:

the diamond moderator is configured to receive the beta particles having energies that are spread out over a wider range including higher energies; and the diamond moderator is configured to provide the electrons concentrated in a narrower range at lower energies.

8. A system comprising:

a load configured to receive electrical power; and a betavoltaic battery comprising:

a beta particle source configured to provide beta particles having energies that are spread out over a wider range including higher energies;

a diamond moderator configured to convert at least some of the beta particles into lower-energy electrons concentrated in a narrower range at lower energies; and a PN junction configured to receive the electrons and to provide the electrical power to the load;

wherein the diamond moderator is located between the beta particle source and the PN junction.

9. The system of claim 8, wherein:

the PN junction is located on a first substrate; and the beta particle source is located within a second substrate.

10. The system of claim 8, wherein the diamond moderator comprises a diamond material and a dopant.

11. The system of claim 8, further comprising:

a resistor coupled to the load, the resistor and the load collectively having a resistance that regulates an output power of the battery against a half-life of the beta particle source.

12. The system of claim 8, wherein the load comprises one of: a remote sensor, an anti-tamper device, and a robot.

13. A system comprising:

a load configured to receive electrical power; and a betavoltaic battery comprising:

a beta particle source configured to provide beta particles;

a diamond moderator configured to convert at least some of the beta particles into lower-energy electrons;

a PN junction configured to receive the electrons and to provide the electrical power to the load; and an electron amplifier configured to bias the diamond moderator;

wherein the diamond moderator is located between the beta particle source and the PN junction.

14. The system of claim 13, wherein the electron amplifier is configured to receive some of the beta particles and to generate additional electrons that bias the diamond moderator.

15. The system of claim 13, wherein the electron amplifier comprises a second PN junction and a resistor, the resistor coupled between a substrate and the diamond moderator, the resistor also coupled to one region of the PN junction.

16. The system of claim 13, wherein:

the diamond moderator is configured to receive the beta particles having energies that are spread out over a wider range including higher energies; and the diamond moderator is configured to provide the electrons concentrated in a narrower range at lower energies.

17. A method comprising:

generating beta particles using a beta particle source;

converting at least some of the beta particles into lower-energy electrons using a diamond moderator; and providing electrical power to a load based on the electrons using a PN junction;

wherein the diamond moderator is located between the beta particle source and the PN junction;

wherein the diamond moderator receives the beta particles having energies that are spread out over a wider range including higher energies; and wherein the diamond moderator provides the electrons concentrated in a narrower range at lower energies.

18. A method comprising:

generating beta particles using a beta particle source;

converting at least some of the beta particles into lower-energy electrons using a diamond moderator;

providing electrical power to a load based on the electrons using a PN junction; and biasing the diamond moderator using an electron amplifier;

wherein the diamond moderator is located between the beta particle source and the PN junction.

19. The method of claim 18, wherein the electron amplifier receives some of the beta particles and generates additional electrons that bias the diamond moderator.

20. The method of claim 18, wherein:

the diamond moderator receives the beta particles having energies that are spread out over a wider range including higher energies; and the diamond moderator provides the electrons concentrated in a narrower range at lower energies.

* * * * *